United States Patent [19]

Abe et al.

[11] 4,033,519

[45] July 5, 1977

[54] METHOD AND APPARATUS FOR AUTOMATICALLY CHANGING BOBBINS AND WINDING YARN CONTINUOUSLY

[75] Inventors: Isamu Abe; Takami Sugioka, both of Matsuyama, Japan

[73] Assignees: Teijin Limited; Teijin Seiki Co., Ltd., both of Osaka, Japan

[22] Filed: May 28, 1975

[21] Appl. No.: 581,590

[30] Foreign Application Priority Data

June 6, 1974 Japan ..... 49-63351
Nov. 26, 1974 Japan ..... 49-135191

[52] U.S. Cl. ..... 242/18 A; 242/18 PW
[51] Int. Cl.² ..... B65H 54/06; B65H 67/04
[58] Field of Search ..... 242/18 A, 18 PW, 18 DD, 242/25 A

[56] References Cited

UNITED STATES PATENTS

| | | | |
|---|---|---|---|
| 1,912,250 | 5/1933 | Borletti | 242/18 A X |
| 2,772,054 | 11/1956 | Herele et al. | 242/18 A |
| 3,103,305 | 9/1963 | Heatherly | 242/18 PW |
| 3,109,602 | 11/1963 | Smith | 242/18 A |
| 3,276,704 | 10/1966 | Pabis | 242/18 PW |
| 3,695,521 | 10/1972 | Torii et al. | 242/18 A |
| 3,856,222 | 12/1974 | Wust | 242/18 A |
| 3,857,522 | 12/1974 | Fink | 242/18 A |
| 3,913,852 | 10/1975 | Lenk et al. | 242/18 A |

FOREIGN PATENTS OR APPLICATIONS

| | | | |
|---|---|---|---|
| 824,524 | 10/1969 | Canada | 242/18 PW |
| 34,422 | 11/1970 | Japan | 242/18 A |
| 1,071,073 | 6/1967 | United Kingdom | 242/18 A |

*Primary Examiner*—Stanley N. Gilreath
*Attorney, Agent, or Firm*—Burgess, Ryan and Wayne

[57] ABSTRACT

An improved method and apparatus for automatically changing bobbins and winding yarn continuously in a winding or taking-up apparatus provided with a rotatable turret whereon a pair of bobbin holders are rotatably mounted. Each bobbin utilized for this apparatus is provided with a yarn catching groove formed on a peripheral portion thereof. When the bobbin exchanging operation is carried out, the turret is turned in a direction opposite to the rotational direction of fresh and full packaged bobbins held by the corresponding bobbin holders so that the yarn passed through a traverse guide of the apparatus is aligned with the yarn catching groove of the fresh bobbin whereby the yarn is engaged with the above-mentioned yarn catching groove.

7 Claims, 13 Drawing Figures

METHOD AND APPARATUS FOR AUTOMATICALLY CHANGING BOBBINS AND WINDING YARN CONTINUOUSLY

BACKGROUND OF THE INVENTION

This invention relates to a method for automatically changing bobbins and winding yarns continuously threrupon and an apparatus for working this method. More particularly, the invention relates to a revolving-type winding method in which a yarn is continuously wound on bobbins held on bobbin holders rotatably mounted on a rotatable turret while automatically replacing a fully wound bobbin with an empty bobbin, and to an apparatus for practising this winding method.

In conventional continuous yarn winding apparatuses including an automatic bobbin exchange mechanism, for example, as is disclosed in the specification of British Pat. No. 1,322,182, a yarn to be transferred from a full bobbin to an empty bobbin is caught by yarn-guiding fittings mixed to the end of a bobbin holder for holding a bobbin thereon, or by thread-guiding fittings held on a bobbin holder with a bobbin.

When the bobbin exchange is conducted by using such conventional apparatus, a yarn wraps around the yarn-guiding fittings in a complicated manner and such operations as the treatment of the yarn end after doffing of a full bobbin and the dismounting and mounting of yarn-guiding fittings become complicated. Accordingly, various difficulties are involved in automating treatments subsequent to the doffing step and, if these treatments are made automatic, equipment costs are tremendously high so that no economical advantages can be attained.

For overcoming these difficulties, it was proposed to form a yarn-catching circular groove on a bobbin. However, when bobbins having a groove on the periphery thereof are employed, the ratio of success in catching the yarn end is very low resulting in reduction of productivity and operational efficiency. Especially when it is intended to perform the bobbin exchange automatically, this defect becomes a serious obstacle.

As a result of our investigations made to clarify why the ratio of success in catching the yarn end is low in the method using bobbins having a circular groove formed on the periphery thereof, we found that since the yarn is maintained under excessive tension when it is about to be engaged with the circular groove of a bobbin, it is very difficult for the bobbin to hold the yarn by the circular groove, and that since the yarn is not properly aligned with the circular groove, the yarn cannot be engaged with said circular groove.

A yarn-guide or the like may be used for aligning a yarn with a circular groove, in order to avoid said problem. However, if a yarn-guide or the like is used, the yarn is relaxed in the vicinity of the bobbin. Since a yarn in the relaxed state has a property that it is likely to wrap around a rotary member disposed in the vicinity thereof, for example, a roller or the like, winding of the relaxed yarn on a roller located in the vicinity of the yarn passage is enhanced as well as winding of the yarn on the bobbin. Further, properly alignment of the yarn with the circular groove on a bobbin cannot be obtained even if the utmost efforts are made using the conventional method, because limitations are imposed on the precision of positioning the groove and the yarn is inevitably unstable when travelling.

It is a primary object of this invention to provide a method and apparatus for automatically changing bobbins and winding yarn continuously thereupon, in which the above-mentioned defects and disadvantages involved in conventional techniques can be overcome, namely such method and apparatus in which full bobbins, where the yarn ends can easily be handled as steps subsequent to doffing, can be obtained and exchange of bobbins can be done very smoothly without troubles.

In the method of this invention for automatically changing bobbins and winding yarn continuously thereupon, a yarn catching groove is formed at the end of a bobbin instead of yarn-guiding fittings used for catching the yarn in the conventional techniques. On exchange of bobbins a turret is rotated in a direction opposite to the rotational direction of the bobbins, so that the yarn is aligned with the groove and engaged with the grooved bobbin.

An apparatus of this invention for automatically changing bobbins and winding yarn continuously thereupon, which is used for practising the aforesaid method smoothly and assuredly, comprises a turnable turret on which a plurality of bobbin holders for holding bobbins are rotatably mounted, means for rotating the bobbins held on said bobbin holders, and traverse means for traversing said yarn upstream of said bobbin holders in the axial direction thereof, means for turning said turret to alternate exchange positions of bobbins held on said bobbin holders between a winding position and a standby position, an improvement comprising in combination, said turret turning means being capable of turning said turret in a direction opposite to the rotational direction of said bobbins, a guide disposed upstream of said yarn traverse means for disengaging said yarn from said yarn traverse means, and a yarn catching groove formed at a peripheral portion of each bobbin.

DETAILED DESCRIPTION OF THE INVENTION

The method of this invention for automatically changing bobbins and continuously winding a yarn will now be illustrated by reference to the apparatus of this invention illustrated in FIGS. 1 to 5.

Figure 1:
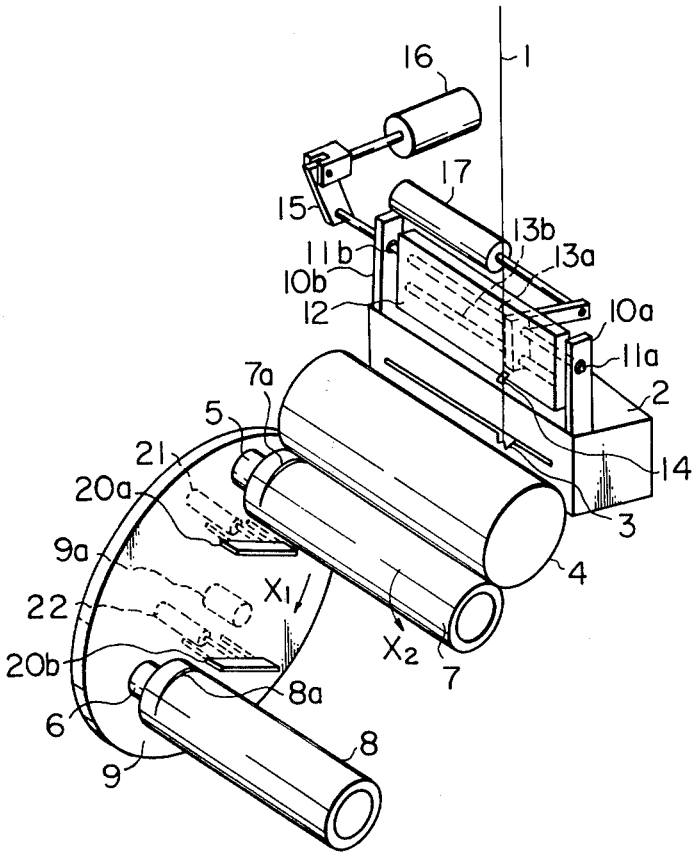
FIG. 1 is a perspective view illustrating an embodiment of the apparatus for practising the method of this invention for automatically changing bobbins and continuously winding a yarn.
Figure 2:
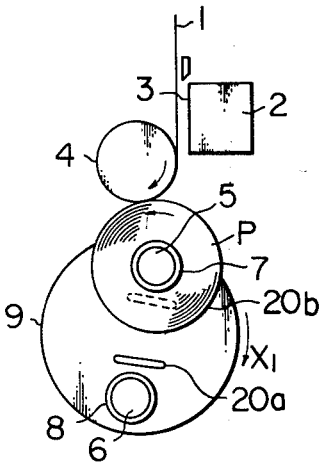
FIG. 2 is a side elevation of the apparatus of FIG. 1 just prior to the completion of a fully wound bobbin.
Figure 3:
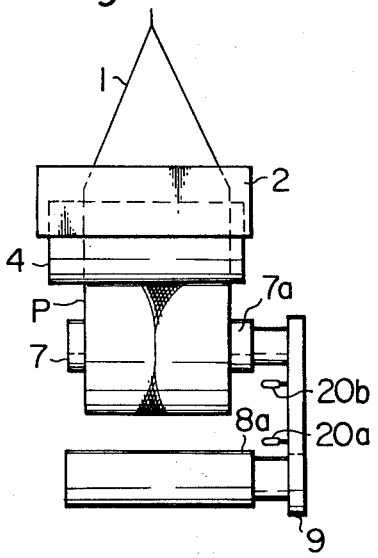
FIG. 3 is a back elevation of the apparatus of FIG. 2.

Referring to FIG. 1, a yarn 1 is traversed by a yarn guide 3 of a traverse device 2, passed through a friction roller 4, and wound on a bobbin 7 or 8 pressed by said roller 4 rotated at a certain speed to form a package. The traverse device 2 and friction roller 4 are carried on a slide block (not shown), capable of rectilinear vertical movement and on the traverse device 2, a yarn disengaging guide 12 is swingably pivoted on bearings 11*a* and 11*b*, formed on brackets 10*a* and 10*b*. A yarn gathering guide 14 is slidably attached to guide bars 13*a* and 13*b*, mounted on the back surface of the guide 12. The guide bar 13*a* also acts as a swinging shaft for the yarn disengaging guide 12, and a sliding cylinder 16 is attached to the top end of the guide bar 13*a* through a lever 15. This cylinder 16 is actuated by air pressure. Further, a yarn gathering cylinder 17, which is actuated by air pressure, is attached to the yarn gathering guide 14.

A turret 9 is rotatably disposed on a shaft 9*a* and is rotated by an actuator (not shown). Bobbin holders 5 and 6 are rotatably mounted on the turret 9 and bobbins 7 and 8 are held on the bobbin holders 5 and 6. The turret 9 is rotated in the clockwise direction indicated by an arrow $X_1$ in FIG. 1, and the rotational direction of the turret 9 is opposite to the rotational direction of the bobbin holders 5 and 6 (the counterclockwise direction shown by an arrow $X_2$ in FIG. 1). Yarn catching grooves 7*a* and 8*a* are formed on ends of the bobbins 7 and 8 on the peripheries thereof.

Guides 20*a* and 20*b* are so disposed that the guide 20*a* or 20*b* on the traverse device side can be projected to the vicinity of the yarn catching groove 7*a* or 8*a* of the bobbin 7 or 8 respectively, from the position of the turret 9 by means of a cylinder 21 or 22 actuated by air pressure.

The exchange of bobbins and the winding of a yarn are conducted in the following manner by using the apparatus having the aforesaid structure.

Figure 4:
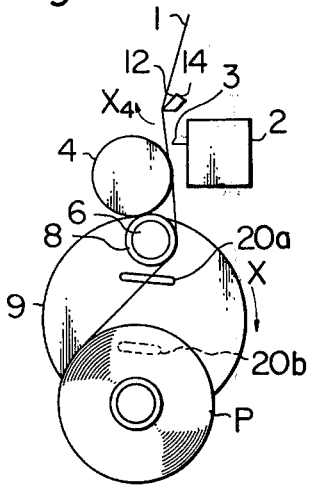
FIG. 4 is a side elevation of the apparatus of FIG. 1 just subsequent to the transfer of an empty bobbin for a full bobbin.
Figure 5:
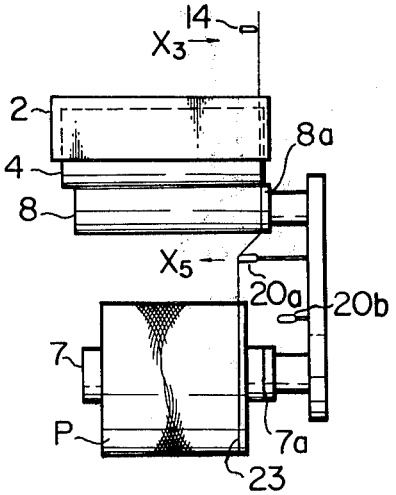
FIG. 5 is a back elevation of FIG. 4.

In the state shown in FIG. 1, a yarn is transferred from a full bobbin to an empty bobbin 7 and the full bobbin is doffed. In this state, winding is started and when the yarn is fully wound on the bobbin 7, a full-bobbin signal is given by a timer (not shown) or the like and the starting of the bobbin 8 is initiated by an auxiliary roller (not shown) in the manner described in the explanation of the second embodiment of the present invention. Then, the turret 9 is rotated in the clockwise direction $X_1$ in FIG. 2 by an actuator (not shown) and a fully wound package P in FIG. 2 on the bobbin 7 rotated while in contact with the surface of the friction roller 4. When the package P separates from the friction roller 4 and an empty bobbin falls in contact with the friction roller 4 (see FIG. 4), the yarn disengaging guide 12 is swung to the direction $X_4$ in FIG. 4 and the yarn 1 is disengaged from the yarn guide 3. Since the yarn tends to move toward a passage having lower yarn tension, the yarn 1 runs along a passage from the fulcrum of the traverse motion to the center of the traverse device 2. The yarn gathering guide 14 is moved in the direction $X_3$ in FIG. 5 and simultaneously, the guide 20*a* is moved in the direction $X_5$ in FIG. 5. Accordingly, when the yarn 1 is aligned with the yarn catching groove 8*a* of the bobbin 8, as shown in FIGS. 4 and 5, the yarn 1 is led to the fully wound package P and a bulge of wound yarn 23 is formed on the package. Further, when the yarn 1 is aligned with the yarn catching groove 8*a* of the bobbin 8 by the yarn gathering guide 14, the portion of the thread 1 extending from the friction roller 4 to the fully wound package P falls into contact with the yarn catching groove 8*a* of the empty bobbin 8.

Since the rotational direction of the bobbin is the opposite of the moving direction of the yarn 1 and the empty bobbin 8 is rotated by the turret 9 in such a manner as will allow intrusion of the yarn 1, the yarn 1 is engaged with the yarn catching groove 8*a* of the empty bobbin 8 and yarn tension between the fully wound package P and the emtpy bobbin 8 increases, whereby the yarn 1 is broken and winding on the empty bobbin 8 is initiated.

When winding of the yarn 1 on the empty bobbin 8 is initiated, the yarn gathering guide 14 is returned to the original position and, then, the yarn disengaging guide 12 is returned to the original position. At this point, a transfer tail is formed on the empty bobbin 8 by means of the yarn gathering guide 14 and the yarn disengaging guide 12, and the yarn 1 is engaged with the yarn guide 3 of the traverse device 2 to initiate normal winding. In the same manner as described above, the yarn is continuously wound on bobbins while full bobbins are replaced with empty bobbins.

In the foregoing embodiment, the guides 20*a* and 20*b* are mounted on the turret. It is possible to dispose the guides on the lower side of the traverse device 2 so that guides are pushed in between the bobbins 7 and 8. This modification is especially preferred for the so-called tandem-type apparatus in which two bobbins are held on one bobbin holder.

An embodiment where the method of this invention is applied to a winding machine of the tandem type will now be described by reference to FIGS. 6 through 10. For facilitating understanding of the description, members mentioned in the foregoing embodiment are indicated by the same reference numerals.

Figure 6:
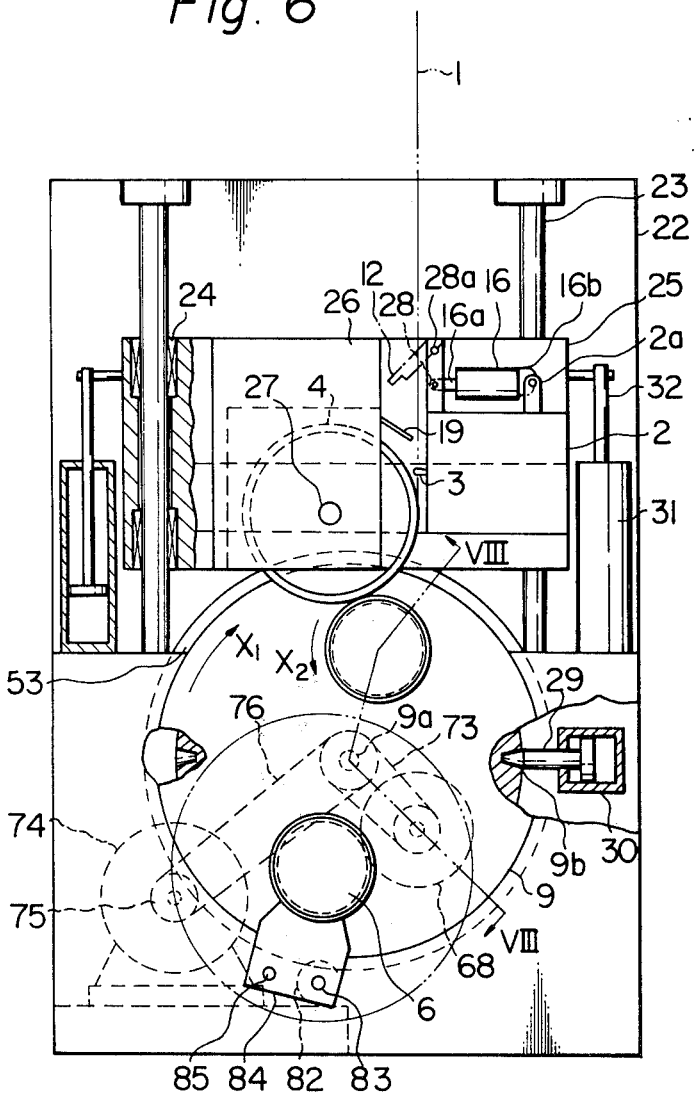
FIG. 6 is a front view of a tandem-type apparatus for automatically changing bobbins and winding yarns continuously according to this invention.
Figure 7:
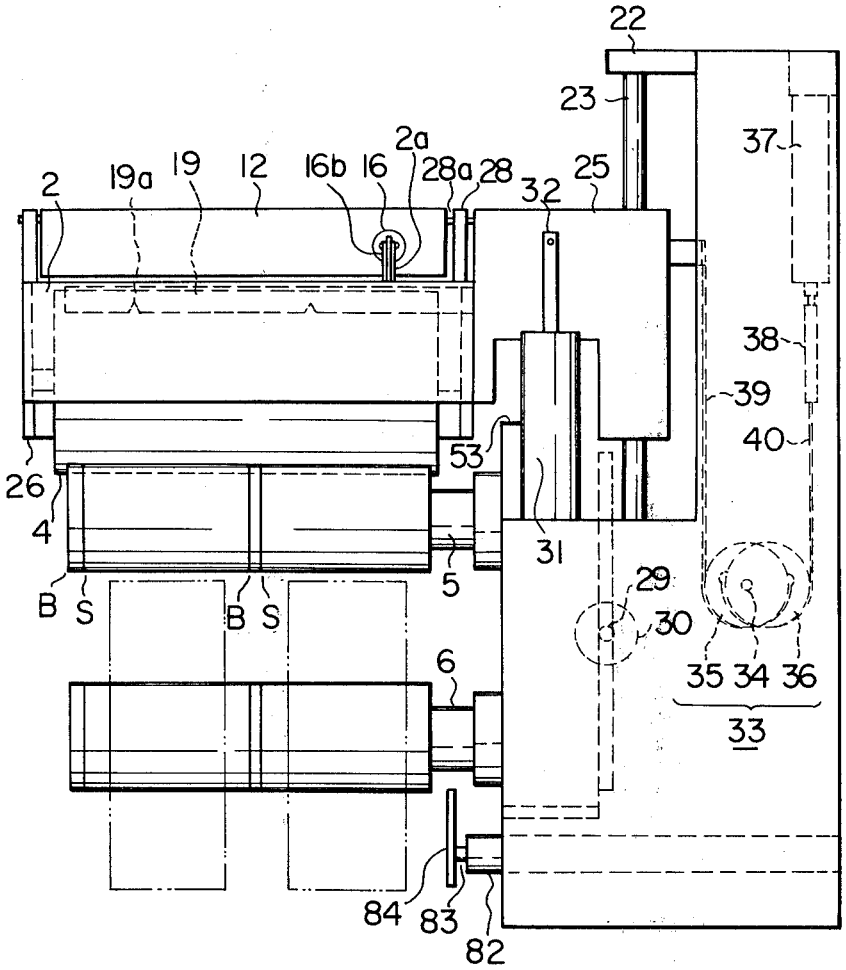
FIG. 7 is a view showing the right side of the apparatus shown in FIG. 6.

Referring to FIGS. 6 and 7, two slide shafts 23 extending in the vertical direction are fixed to a machine frame 22, and a slide block 25 is moved rectilinearly and vertically along the slide shafts 23 by a slide bearing 24. The slide block 25 carries a traverse device 2 having a pair of traverse guides 3 for traversing a yarn 1 in the traverse zone and a rotatable friction roller 4 connected to a drive motor (not shown). A case 26 is provided with a bearing 27 supporting the friction roller 4. A pair of brackets 28 are mounted on the traverse device 2 to swingably support a yarn disengaging guide 12 extending in the traverse direction of the traverse guide 3 by means of a pin 28*a*. The top end of a rod 16*a* of a swinging cylinder 16 and the rear end 16*b* of the cylinder 16 are pin-engaged with the yarn disengaging guide 12 and a bracket 2*a* disposed on the traverse device 2, respectively. When the rod 16*a* is projected, the yarn disengaging guide 12 is swung so as to cross the passage of the yarn 1 and disengages the running yarn 1 from the traverse guide 3. A guide 19 is fixed to the case 26 to face the yarn disengaging guide 12 fixed to the traverse device 2 with the yarn lying therebetween. Case 26 also supports the friction roller 4, while slide block 25 supports case 26 and traverse device 2. The guide 19 has one V-shaped recess 19*a* in each traverse zone.

A turret 9 is rotatably supported on a shaft 9*a*, and mounts bobbin holders 5 and 6 rotatably. A circular groove S having a V-shaped section is formed on the peripheral surface of a bobbin B in the vicinity of the end face thereof. Two bobbins are held on each of the bobbin holders 5 and 6. On the peripheral surface of the turret 9, a pair of positioning recesses 9*b* are formed at positions symmetrical to each other with respect to the shaft 9*a*. A cylinder 30 is mounted on the machine frame 22 to move forward and backward positioning pins 29, which are engaged with said recesses 9*b*.

A main cylinder 31 is mounted to support the slide block 25 thereon by means of a rod 32 in order to displace said slide block in an upward or downward direction. A compressed fluid is fed into the main cylinder 31 through a conduit (not shown) to push up the slide block 25. Feeding of the compressed fluid is controlled by a control valve (not shown) so that the slide block 25 is always lifted up with a certain force against the total weight of the slide block 25 carrying thereon the friction roller 4, the traverse device 2 and a motor driving these members as well as the frictional force generated when the slide block 25 slides along the slide shafts 23.

A contact pressure control device 33 including a pulley 35 and an eccentric cam 36 is mounted on a shaft 34 rotatably supported on the machine frame 22. Belts 39 and 40, the ends of which are connected to the slide block 25 and a rod 38 of an auxiliary cylinder 37, respectively, are hung on the pulley 35 and the eccentric cam 36, respectively, in directions reverse to each other.

The eccentric cam 36 is disposed so that as shown in FIG. 7, at initiation of winding, namely in the state where the friction roller 4 is directly in contact with the bobbin B, the belt 40 separates from the point most distant from the shaft 34. When a compressed fluid is fed to the auxiliary cylinder 37 through a conduit (not shown), the slide block 25 is pushed down against the pushing-up force of the main cylinder 31, whereby the friction roller 4 is urged toward the bobbin B. As the diameter of the package wound on the bobbin B increases, the eccentric cam 36 is rotated to reduce the above-mentioned contact pressure.

Figure 8:
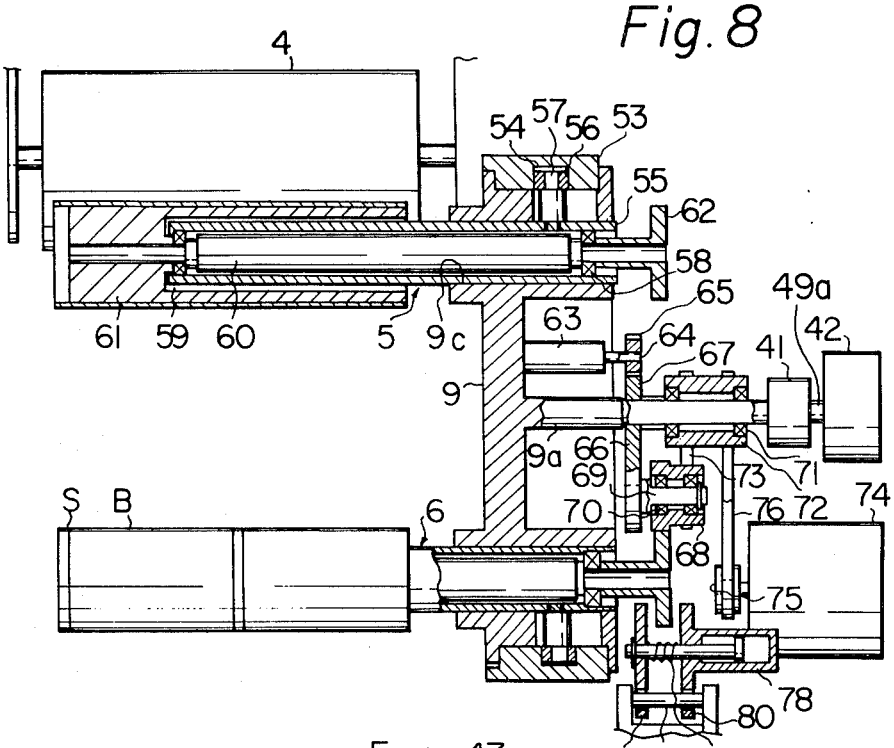
FIG. 8 is a view showing the section taken along the line VIII—VIII in FIG. 6.
Figure 9:
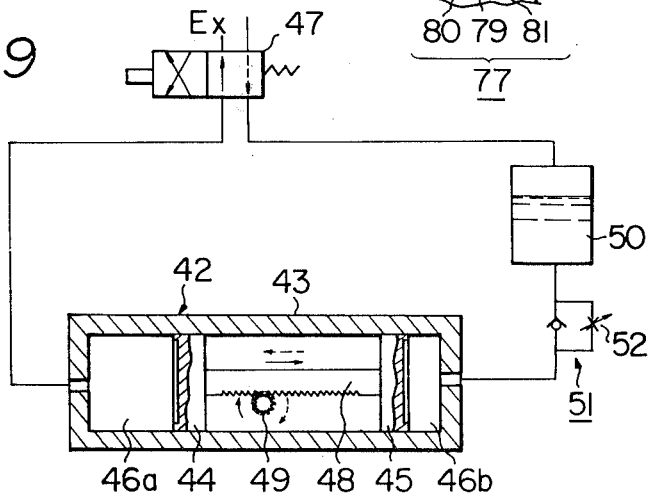
FIG. 9 is an air pressure circuit diagram of an actuator for rotating a turret.

As is shown in FIG. 8, an actuator 42 is connected to the turret 9 through a so-called one-way clutch 41 and shaft 49*a* for transmitting a rotation of pinion 49 in one direction to one end of the shaft 9*a*. As is shown in FIG. 9, in the actuator 42, pistons 44 and 45 are fitted to a cylinder 43 to form pressure chambers 46*a* and 46*b*. A compressed fluid such as compressed air is caused to act on the pressure chambers 46*a* and 46*b* alternately by means of a change-over valve 47, whereby the pistons 44 and 45 are caused to make a reciprocating movement and rotate a pinion 49 engaged with a rack formed on a rod 48 connecting the pistons 44 and 45 to each other. The rotary movement of the actuator 42 is transmitted to the turret 9 as a one-direction rotation, namely as the clockwise direction rotation indicated by the arrow X1. This rotational direction indicated by an arrow X1 is opposite to the rotational direction X2 of the bobbin. Oil is filled in the pressure chamber 46*b* positioned on the exhaust side when the turret 9 is rotated in the direction X1, and a speed controller 51 is disposed between the pressure chamber 46*b* and an auxiliary oil tank 50. The rotation of the turret 9 connected to the actuator 42 can be smoothly adjusted by controlling the opening of a throttle valve 52 of the speed controller 51.

In FIG. 8, an annular guide 53 is fitted to the peripheral surface of the turret 9 and is attached to the machine frame 22. The guide 53 has a cam groove 54 on the inner peripheral surface. The guide 53 may be divided into two portions for easier maintenance. Bobbin holder inserting holes 9*c* are perforated in the turret 9 to receive therein sliding cylinders 55 of the bobbin holders 5 and 6 so that they can move in the axial direction. A pin 57 is screwed to the surface of the sliding cylinder 55 to support a cam follower 56 thereon to be inserted into the cam groove 54. A shaft 60 is positioned inside of the sliding cylinder 55 via bearings 58 and 59. A head 61 for receiving a bobbin B thereon is fixed to the front end of the shaft 60 and a pulley 62 is fixed to the rear end of the shaft 60. With rotation of the turret 9, the cam groove 54 acts together with the cam follower 56 for moving the bobbin holders 5 or 6 in the axial direction toward the side of the turret 9 and returning them to their original positions again.

A rotary actuator 63 is fitted to the turret 9, and a pinion 65 attached to the top end of a rod 64 of the actuator 63 is turned left or right by means of a compressed fluid. The pinion 65 is engaged with teeth 65 formed on the rear end of an arm 66 pivoted swingably on the shaft 9*a*, and the arm 66 is swung around the shaft 9*a* with rotation of the pinion 65. On the top end of the arm 66, an auxiliary roller 68 is rotatably supported by means of a pin 69 and a bearing 70. A belt 73 is extended between the auxiliary roller 68 and an intermediate pulley 72 rotatably supported by a bearing 71. A belt 76 is extended between the intermediate pulley 72 and a pulley 75 connected to an auxiliary motor 74 fixed to the machine frame 22. The rotation of the motor 74 is transmitted to the auxiliary roller 68 through the belt 76, the intermediate pulley 72 and the belt 73, and the bobbin holder 5 or 6 is rotated by the pressing of the auxiliary roller 68, to which rotation is given by the rotary actuator 63, against the pulley 62 located at the end of the bobbin holder 5 or 6.

A brake device 77 for the bobbin holders comprises a pair of discs 80 actuated by a fluid pressure cylinder 78 and moved along a guide shaft 79, and a spring 81 adjusting the distance between the discs 80 to adjust the degree of braking by the discs 80.

As shown in FIGS. 6 and 7, a push-out cylinder 82 is fixed to the machine frame 22 to doff a full bobbin from the bobbin holder and a push-out piece 84 is attached to a rod 83 of the push-out cylinder 82 so that the upper end of the push-out piece 84 presses the end portion of the bobbin B. A guide 85 is disposed to prevent oscillating movement of the push-out piece 84.

Bobbin exchange and yarn winding conducted by using the apparatus of this invention having the above-mentioned structure will now be described.

Figure 10A:
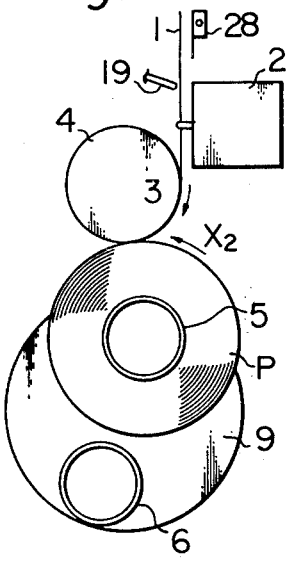
FIG. 10A is a side elevation of the apparatus of FIG. 6 just prior to the completion of two fully wound bobbins.
Figure 10B:
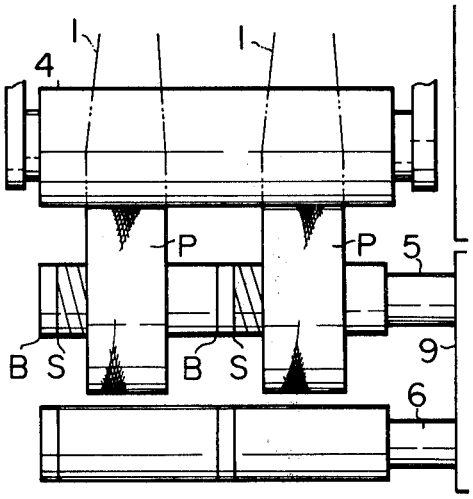
FIG. 10B is a back elevation of FIG. 10A.
Figure 10C:
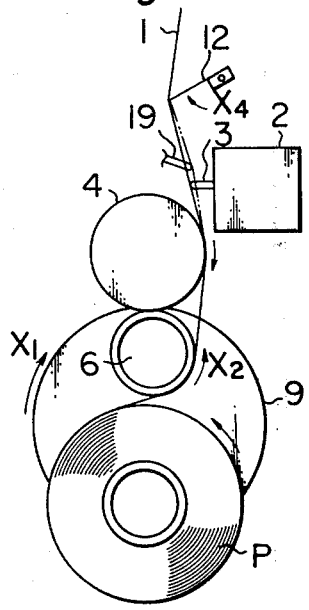
FIG. 10C is a side elevation of the apparatus of FIG. 6 just subsequent to the transfer of a pair of empty bobbins for a pair of full bobbins.
Figure 10D:
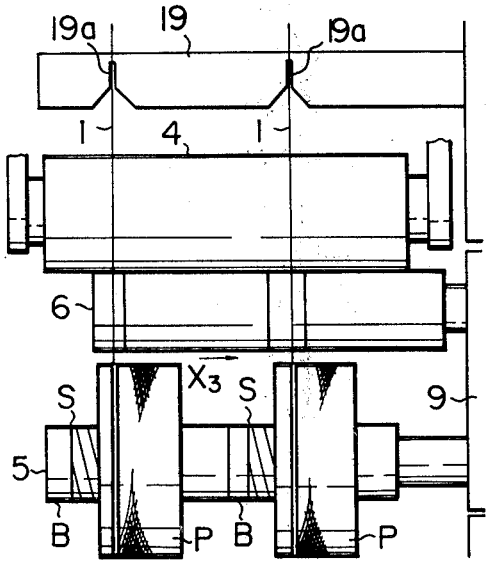
FIG. 10D is a back elevation of FIG. 10C.

In the state shown in FIGS. 6 and 7, a yarn 1 is wound on a bobbin B held on the bobbin holder 5 while the yarn 1 is traversed by the traverse guide 3 of the traverse device 2. When the bobbin becomes full as shown in FIGS. 10A and 10B, a full bobbin signal is given by a timer (not shown) or the like. In response to this signal, the auxiliary motor 74 is turned on to initiate rotation of the auxiliary roller 68, and by the rotary actuator 63 the auxiliary roller 68 is caused to press the pulley 62 of the bobbin holder 6 on which an empty bobbin B is held, whereby the rotation of the bobbin B is initiated. Then, the cylinder 30 is actuated to draw out the positioning pin 29 from the recess 9*b* and the turret 9 is rotated in the clockwise direction (the direction indicated by an arrow X1) by the actuator 42, whereupon the full bobbin on the bobbin holder 5 and the empty bobbin on the bobbin holder 6 are rotated. With rotation of the turret 9, cam followers 56 mounted on the bobbin holders 5 and 6 and cam grooves 54 formed on the cams 53 are engaged with each other and the bobbin holder 6 carrying the empty bobbin thereon is moved in the axial direction (the direction indicated by an arrow X3 in FIG. 10D). At this point, the peripheral groove S of the empty bobbin B held on the bobbin holder 6 slightly exceeds the recess 19*a* of the guide 19 and is located in the traverse zone of the traverse guide 3. When the turret 9 is further rotated, the full bobbin separates from the friction roller 4. Then, the auxiliary roller 68 is switched over from the pulley 62 of the bobbin holder 6 carrying the empty bobbin to the pulley 62 of the bobbin holder 5 carrying the full bobbin. When the turret 9 is further rotated, the empty bobbin falls into contact with the friction roller 4. After the yarn 1, being wound on the full bobbin from the traverse guide 3, has been placed in contact with the surface of the empty bobbin, the swinging cylinder 16 is actuated in the direction indicated by an arrow X4 as shown in FIG. 10C to swing the yarn disengaging guide 12. The yarn 1 is bent between the yarn disengaging guide 12 and the guide 19 as indicated by a two-dot chain line in FIG. 10C. In this state, when the yarn 1 is traversed by the traverse guide 3, the yarn 1 slides on the peripheral face of the guide 19 while in contact therewith and arrives at and falls into the recess 19*a* formed on the guide 19. Thus, the yarn 1 is released from the traverse guide 3 as indicated by a solid line in FIG. 10C, and a bulge of wound yarn is formed on the full bobbin at a position corresponding to the recess 19*a*. While the turret 9 continues the rotation, the bobbin holder 6 carrying the empty bobbin is moved in a direction opposite to the above-mentioned direction, and the circular groove S formed on the periphery of the empty bobbin is shifted toward the yarn 1 being wound. When the circular groove S is in alignment with the yarn 1, since the rotational direction of the empty bobbin (the direction X2) is opposite to the moving direction of the yarn 1 and since the rotational direction of the turret 9 (the direction X1) is opposite to the rotational direction of the bobbin (the direction X2), the yarn 1 is allowed to move into the circular groove S of the empty bobbin S and is always engaged with this groove S. At this moment, yarn tension between the full bobbin and the empty bobbin increases, whereby the yarn 1 is cut and winding of the yarn 1 on the empty bobbin is initiated. Then, the auxiliary motor 74 is turned off, and the auxiliary roller 68 pressing the pulley 62 of the bobbin holder 5 carrying the full bobbin is stopped and the movement of the pulley 62 is controlled by the brake device 77. On the other hand, a transfer tail of several turns, in general, is formed on the end portion of the empty bobbin while the bobbin holder 6 carrying the empty bobbin is returned to the normal winding position with the yarn 1 being wound thereon. By feeding a compressed fluid to the cylinder 30 up to this moment, the positioning pin 29 is engaged with the recess 9*b*, whereby the turret 9 is settled at the prescribed position.

As soon as, or just before or after, the bobbin holder 6 arrives at the normal winding position, the yarn disengaging guide 12 is returned to the original position by means of the swinging cylinder 16. Thus, the yarn 1 is released from the yarn disengaging guide 12 and the guide 19, and it travels along the thread passage crossing the traverse zone of the traverse guide 3 and is engaged with the traverse guide 3 to start the normal winding.

After the full bobbin has been stopped, the full bobbin is doffed from the bobbin holder 5 by the push-out piece 84 fixed to the push-out cylinder 82, and an empty bobbin B is donned on the bobbin holder 5 and is prepared for the next bobbin exchange.

As the traverse mechanism of the apparatus of this invention, a belt traverse mechanism, a cam traverse mechanism or any of the other known traverse mechanisms can be employed. Cutting of the yarn between the empty bobbin and the full bobbin may be accomplished by using appropriate cutting means. Although the circular groove is formed on the front side of the bobbin in the foregoing embodiment, the circular groove may be formed on the frame side. In this case, the bobbin is shifted toward the front side at the time of bobbin exchange. Further, it is possible to allow the full bobbin and empty bobbin to be in contact with the friction roller when they are exchanged. Furthermore, the bobbin drive system is not limited to the friction drive system using a friction roller as shown in the foregoing embodiment, but it is possible to adopt the spindle system where the bobbin holder is driven and rotated by a motor disposed coaxially with the bobbin holder. Although the slide block carrying thereon the friction roller and the traverse device is moved rectlinearly in the vertical direction in the foregoing embodiment, such an arrangement may be made that the bobbin holder is moved in the horizontal direction instead of the slide block.

In the contact pressure control device 33 a counter weight, a spring or a torque motor may be employed instead of the cylinder 31 and/or the cylinder 37.

In the apparatus of this invention, by virtue of the feature that the rotational direction of the bobbin holder is opposite to the rotational direction of the turret and the yarn is running in the opposite direction while in contact with the surface of the bobbin, at the time of the bobbin exchange the yarn tension is slightly reduced upstream of the bobbin and the running yarn comes to have a property such that it is readily wound on the bobbin, whereby the yarn is engaged with the circular groove of the bobbin with certainty and the ratio of success in the transfer is drastically improved. This reduction of the tension is very slight and the degree of the tension reduction is not such that the running yarn is readily wound on rollers disposed upstream of the bobbin. Further, in the apparatus of this invention, since the yarn is engaged with the circular groove formed on the periphery of the bobbin while the bobbin holder is being moved in the axial direction so that the circular groove exceeds the recess formed on the guide, holding of the yarn by the circular groove is done with certainty without being influenced by the unstable movement of the yarn or the processing precision of the groove. During the bobbin exchange, the yarn tension retains normal value so that no undue damage such as uneveness of dyeability occurs. Moreover, since a transfer tail is formed simultaneously with the holding of the yarn, no excessive winding is caused on the bobbin, and treatments subsequent to the doffing step can be performed very easily and the transfer tail is not disturbed by the excessive winding. Still further in this invention, since no yarn guiding fittings are used, treatment of such fittings is unnecessary and automatic handling of bobbins and packages subsequent to the doffing step can be greatly facilitated. In case such fittings are employed, in order to prevent detachment of the fittings at high speed rotation, the fittings are disposed at a closer position to the machine frame than that of bobbins, so that a transfer tail can generally be formed only on the frame side of the bobbin. In contrast, according to this invention, a transfer tail may be formed on any optional side of the bobbin and hence, it is possible to optionally select the direction of winding of the yarn on the bobbin and the position of the transfer tail depending on the use.

As is apparent from the foregoing illustration, acording to this invention, the ratio of success in the transfer of the yarn is greatly improved and the post treatments can be greatly facilitated. Accordingly, this invention makes great contributions to the improvement of productivity.

What is claimed is:

1. In an apparatus for automatically changing bobbins and winding a yarn thereupon continuously which comprises a turnable turret on which a plurality of bobbin holders for holding bobbins are rotatably mounted, means for rotating bobbins held on said bobbin holders, and traverse means for traversing said yarn upstream of said bobbin holders in the axial direction thereof, means for turning said turret to alternate exchange positions of bobbins held on said bobbin holders between a winding position and a standby position, the improvement wherein said bobbin rotating means comprises a motor, a friction roller driven by said motor for driving said bobbin held on said bobbin holders when the peripheral surface of said bobbin contacts with said friction roller, a power transmission means for transmitting a driving power from said motor to said friction roller, auxiliary means for driving said bobbin for contacting said bobbin with said friction roller and comprising an arm swingably mounted on a shaft of said turret, an auxiliary roller rotatably mounted on said arm, a further motor disposed on a machine frame, and a power transmission means for transmitting driving power of said further motor to said friction roller, and wherein said turret turning means comprises means for turning said turret in a direction opposite to the rotational direction of said bobbins at the time of bobbin exchange, a guide disposed upstream of said yarn traverse means for disengaging said yarn from said yarn traverse means, and a yarn catching groove formed at a peripheral portion of each bobbin.

2. An apparatus as set forth in claim 1 wherein said yarn catching groove formed at a peripheral portion of each bobbin is located in the vicinity of an axial end portion thereof.

3. An apparatus as set forth in claim 2 wherein each bobbin holder is slidable along an axial direction thereof.

4. An apparatus according to claim 1, further comprising a slide block disposed on a machine frame in a slidable condition in an upward or downward direction relative to said bobbin holder, and means for displacing said slide block, said traverse means and said friction roller being carried by said slide block.

5. An apparatus according to claim 4, wherein said displacing means is a pneumatic cylinder for supporting said slide block.

6. An apparatus as set forth in claim 4, wherein each bobbin holder is slidable along an axial direction thereof.

7. An apparatus according to claim 1, further comprising means for urging said friction roller toward said bobbin, and means for controlling the urging force created by said urging means.

* * * * *

UNITED STATES PATENT OFFICE

CERTIFICATE OF CORRECTION

Patent No. 4,033,519 Dated July 5, 1977

Inventor(s) Isamu Abe, et al

It is certified that error appears in the above-identified patent and that said Letters Patent are hereby corrected as shown below:

Column 1, line 19: "No. 1,322,182" should be --1,332,182--.

Column 1, line 21: "mixed" should be --fixed--.

Column 1, line 39: After "low" insert a comma.

Column 4, line 16: "emtpy" should be --empty--.

Column 6, line 26: "teeth 65" should be --teeth 67--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*